United States Patent [19]

Moeller

[11] Patent Number: 4,948,038

[45] Date of Patent: Aug. 14, 1990

[54] FRESHNESS-PRESERVING CONTAINER

[75] Inventor: Robert E. Moeller, New Milford, N.J.

[73] Assignee: Philip Morris Incorporated, New York, N.Y.

[21] Appl. No.: 336,418

[22] Filed: Apr. 11, 1989

[51] Int. Cl.[5] ..... B65D 43/16; B65D 85/10

[52] U.S. Cl. ..... 229/146; 206/271; 206/273; 229/125.37; 229/149; 229/160.1

[58] Field of Search ..... 229/160.1, 146, 149, 229/125.37; 206/268, 270, 271, 273

[56] References Cited

U.S. PATENT DOCUMENTS

| | | | |
|---|---|---|---|
| 2,369,387 | 2/1945 | Williamson et al. | 206/268 |
| 2,369,391 | 2/1945 | Ringler | 206/268 |
| 2,515,327 | 7/1950 | Bergstein | 229/149 |
| 2,531,507 | 11/1950 | Goodyear | 229/149 |
| 2,918,205 | 12/1959 | Zeitter | 229/149 |
| 2,925,212 | 2/1960 | Welsh, Jr. | 229/149 |
| 2,957,617 | 10/1960 | Bolding | 229/149 |
| 3,910,487 | 10/1975 | Jaeschke | 229/149 |
| 4,392,338 | 7/1983 | Fox | 229/160.1 |
| 4,447,003 | 5/1984 | Gray | 229/44 CB |
| 4,481,876 | 11/1984 | Amendola | 100/38 |

FOREIGN PATENT DOCUMENTS

| | | | |
|---|---|---|---|
| 447445 | 3/1948 | Canada | 229/160.1 |
| 3713612 | 11/1988 | Fed. Rep. of Germany . | |
| 585606 | 2/1947 | United Kingdom | 229/160.1 |
| 596645 | 1/1948 | United Kingdom | 229/160.1 |

*Primary Examiner*—Gary E. Elkins

*Attorney, Agent, or Firm*—Jeffrey H. Ingerman

[57] ABSTRACT

A freshness-preserving container is disclosed. The container includes a lid and a base which are connected and which pivot about a hinge line along their rear walls. The front wall of the lid has an inward facing surface disposed toward an outward facing surface on the fornt wall of the base. Between the inward and outward facing surfaces is a freshness-preserving element for preserving the freahness of the contents of the container. The freshness-preserving means includes a flap mounted on either the lid or the base which engages a shoulder on the other part of the container. As the container closes, the flap slides across the shoulder effecting a latch closing and making a clicking sound indicating the freshness-preserving characteristics of the container. An adhering element also may be provided, such as tape or magnetic pieces, for resealing the container when it is closed. In addition, the lid may overlap the base of the container, further contributing to its freshness-preserving characteristics.

16 Claims, 5 Drawing Sheets

FIG. 1
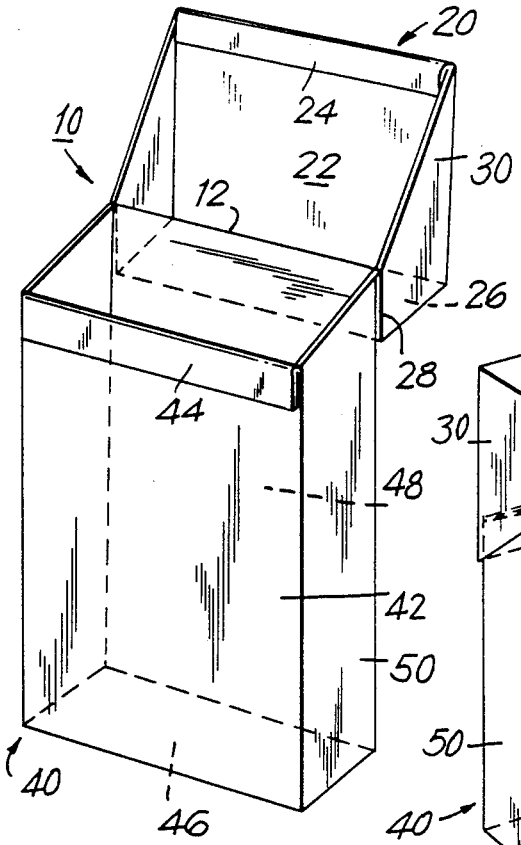
FIG. 2
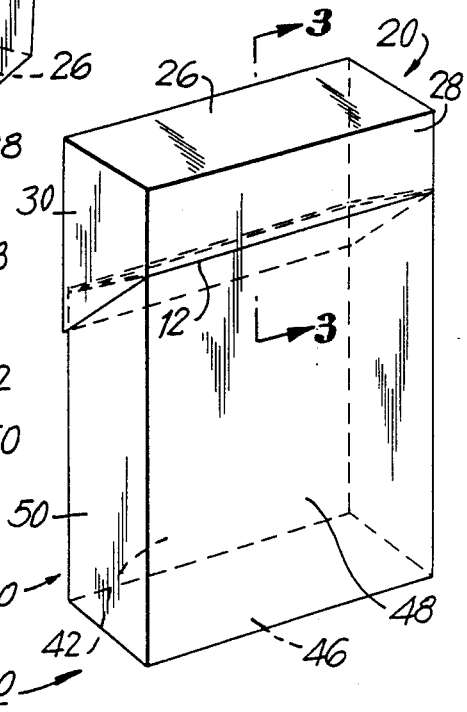
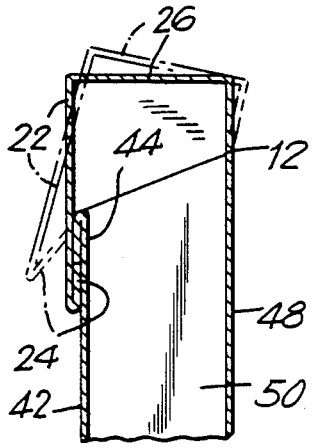
FIG. 3A
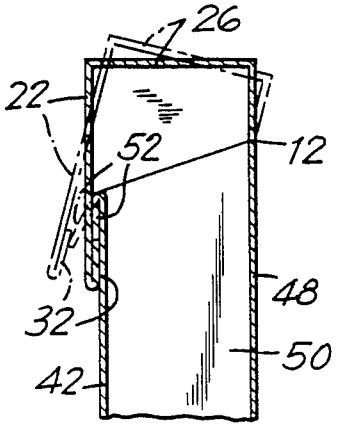
FIG. 3B

FIG. 5
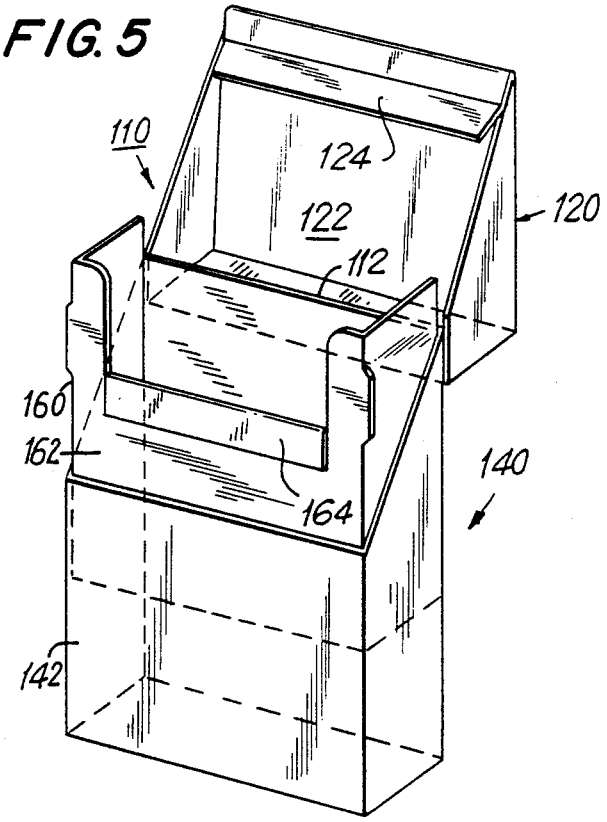
FIG. 3C
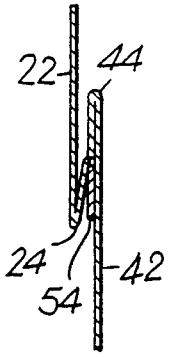
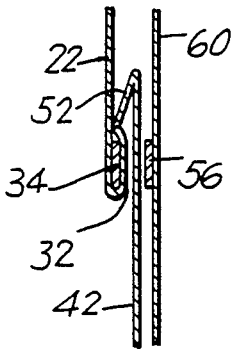
FIG. 3D
FIG. 6
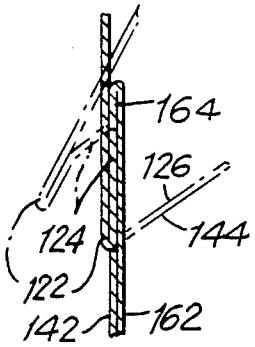
FIG. 10
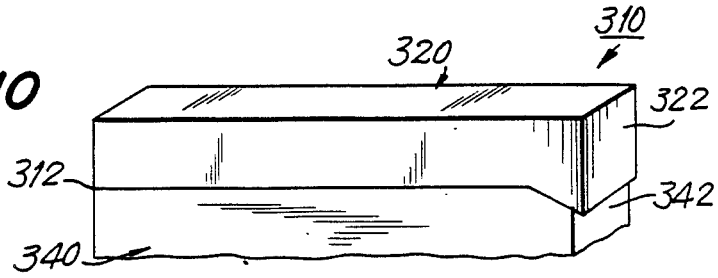

FIG. 7
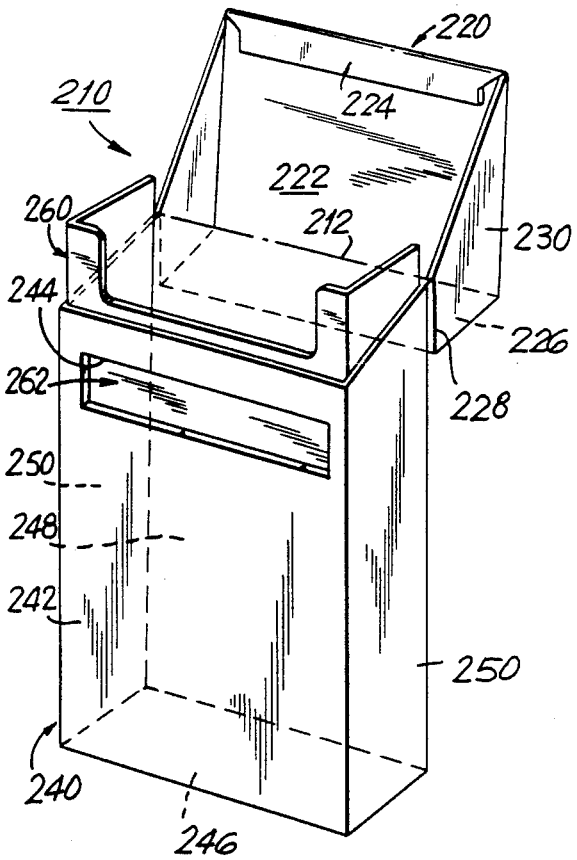
FIG. 8
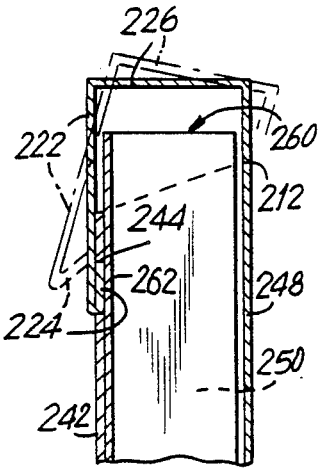
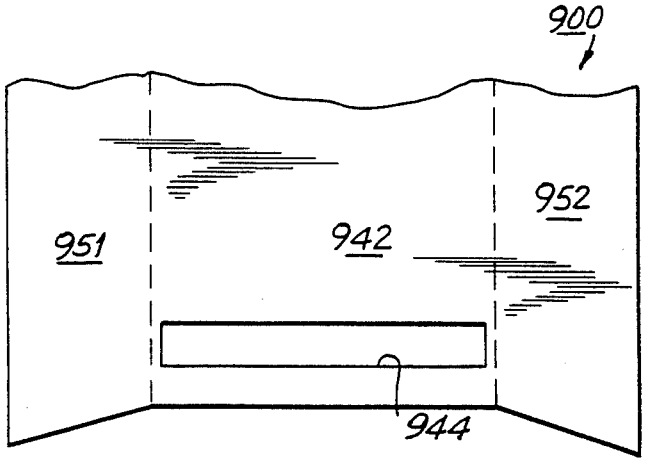
FIG. 9

FRESHNESS-PRESERVING CONTAINER

BACKGROUND OF THE INVENTION

This invention relates to a container such as a box, and particularly to a box of the FLIP-TOP ® or hinged lid variety made from a paperboard blank and designed to preserve the freshness of its contents.

Hinged lid containers such as FLIP-TOP ® boxes are commonly used to contain a variety of products, including tobacco products such as cigarettes, food products such as crackers or biscuits, and other products. Many of these products lose their freshness upon exposure to atmospheric air and humidity, and may also absorb unpleasant odors or tastes to which they are exposed. Therefore, it is common to provide a cellophane wrapper around such a container, or to provide an internal plastic bag inside the box, which remains sealed and air-tight until the container is opened.

Although techniques have been developed for at least partially reclosing a container of this type which has been opened, those techniques are generally unsuitable for a container such as a cigarette box which must be opened and closed several times within a relatively short period of time and with a minimum of inconvenience. The conventional cigarette boxes, both of the FLIP-TOP ® type and of the side-opening type, contain no additional means for preserving freshness other than the reduction in air flow which results from the butting edges of the lid and base members of the package.

It would be advantageous to provide a package having the opening and closing characteristics of the conventional packages but also being provided with means for preserving freshness. It would further be advantageous if the closing or opening of the container provided an audible indication of closure or opening, to remind the user of the freshness-preserving characteristics of the package. Furthermore, it would be advantageous if the ordinary closing of the package would result in a partial resealing of the package.

SUMMARY OF THE INVENTION

It is an object of the present invention to provide a package of the type described above which opens and closes in the same manner as a conventional package but which includes additional means for preserving the freshness of the contents of the package.

It is another object of the invention to provide an audible indication of closing or opening as a reminder to the user of the freshness-preserving characteristics of the package.

It is a further object of the invention to make it possible to effect a partial resealing of the package by the conventional closing operation.

A freshness-preserving container according to the invention has a container height and includes a lid member and a base member, each having a front wall and a back wall parallel to the front wall. The back walls of the lid and base members are connected along a hinge line and are pivotable about the hinge line between a closed position and an opened position. In the closed position the front walls of the lid member and the base member are next to each other, and in the open position the front walls of the lid member and the base member are spaced apart. The lid member may be dimensioned to fit over the base member so that the front wall of the lid member has an inward facing surface which in the closed position is adjacent to an outward facing surface of the front wall of the base member. The container further comprises freshness-preserving means between the adjacent inward and outward facing surfaces of the lid and base members for preserving the freshness of the contents of the container.

The freshness-preserving means may include a flap piece pivotably mounted on either the lid member or the base member, with a corresponding shoulder piece mounted on the other member. When the box is closed, the flap piece will be dragged across the shoulder piece until it passes it, producing a clicking sound, and resulting in a latching effect to hold the container closed and prevent air flow, thus preserving freshness. By pulling the lid member upward sufficiently far, however, the latching effect is overcome, which may also produce a clicking sound. The facing areas of the lid and base members may include adhering means such as tape, magnets or hook-and-loop type fasteners, so that the container will be at least partially resealed in the closed position. The pulling apart of the adhering means may similarly result in an audible sound indicating the opening of the container, reminding the user of its freshness-preserving characteristics. If tape is used as the adhering means, the tape may include an appropriate scent-releasing substance which is activated upon the pulling apart of the tape, providing a further indication to the user of the freshness-preserving characteristics of the container.

A one-piece container blank for forming a freshness-preserving container according to the invention has a hinge line dividing the blank into a lid-defining portion and a base-defining portion. The lid-defining portion and the base-defining portion each comprise a plurality of panels, each panel having a respective length in a direction perpendicular to the hinge line. The panels are foldably connected to each other along score lines defined on the blank and parallel to the hinge line. The lid-defining portion and base-defining portion each include a back wall panel, the back wall panels being connected along the hinge line. The lid-defining portion further includes a top wall panel connected to the lid back wall panel, a lid front wall panel connected to the top wall panel, and a lid flap panel connected to the lid front wall panel. The base-defining portion similarly includes a bottom wall panel connected to the base back wall panel and a base front wall panel connected to the bottom wall panel. The base-defining portion may also include a base flap panel connected to the base front wall panel. Alternatively, the base front wall panel may have a shoulder opening defined therein, one edge of the shoulder opening providing a shoulder. The length of the lid front wall panel and the base front wall panel together are greater than the sum of the lengths of the lid back wall panel and the base back wall panel. As a resut, the lid front wall panel overlaps the base front wall panel in a freshness-preserving container formed from the blank. The lid flap panel and the base flap panel may be foldable toward each other so that the flap panels engage upon the closing of the freshness-preserving container. Alternatively, the lid flap panel may engage the shoulder at one edge of the shoulder opening upon closing the container.

BRIEF DESCRIPTION OF THE DRAWINGS

The above and other objects and advantages of the invention will be apparent after consideration of the following detailed description, taken in conjunction with the accompanying drawings, in which like reference characters represent like parts throughout, and in which:

FIG. 1 is a front perspective view of a container according to the invention in a fully opened position;

FIG. 2 is a rear perspective view of the container of FIG. 1 in a closed position;

FIG. 3A is a cross-sectional view of one embodiment of a freshness-preserving means of the container of FIGS. 1 and 2, taken along line 3—3 of FIG. 2;

FIG. 3B is a cross-sectional view of an alternative embodiment of a freshness-preserving means of the container of FIGS. 1 and 2, taken along line 3—3 of FIG. 2;

FIG. 3C is a cross-sectional view of another alternative embodiment of a freshness-preserving means, including adhering means;

FIG. 3D is a cross-sectional view of yet another alternative embodiment of a freshness-preserving means, including alternative adhering means;

FIG. 5 is a front perspective view of an alternative embodiment of a container according to the invention;

FIG. 6 is a cross-sectional view of the freshness-preserving means of the container of FIG. 5;

FIG. 7 is a front perspective view of another alternative embodiment of a container according to the invention;

FIG. 8 is a cross-sectional view of the freshness-preserving means of the container of FIG. 7;

FIG. 9 is a fragmentary plan view of a blank from which the container of FIG. 7 may be erected;

FIG. 10 is a side perspective view of yet another alternative embodiment of a container according to the invention;

DETAILED DESCRIPTION OF THE INVENTION

Figure 4:
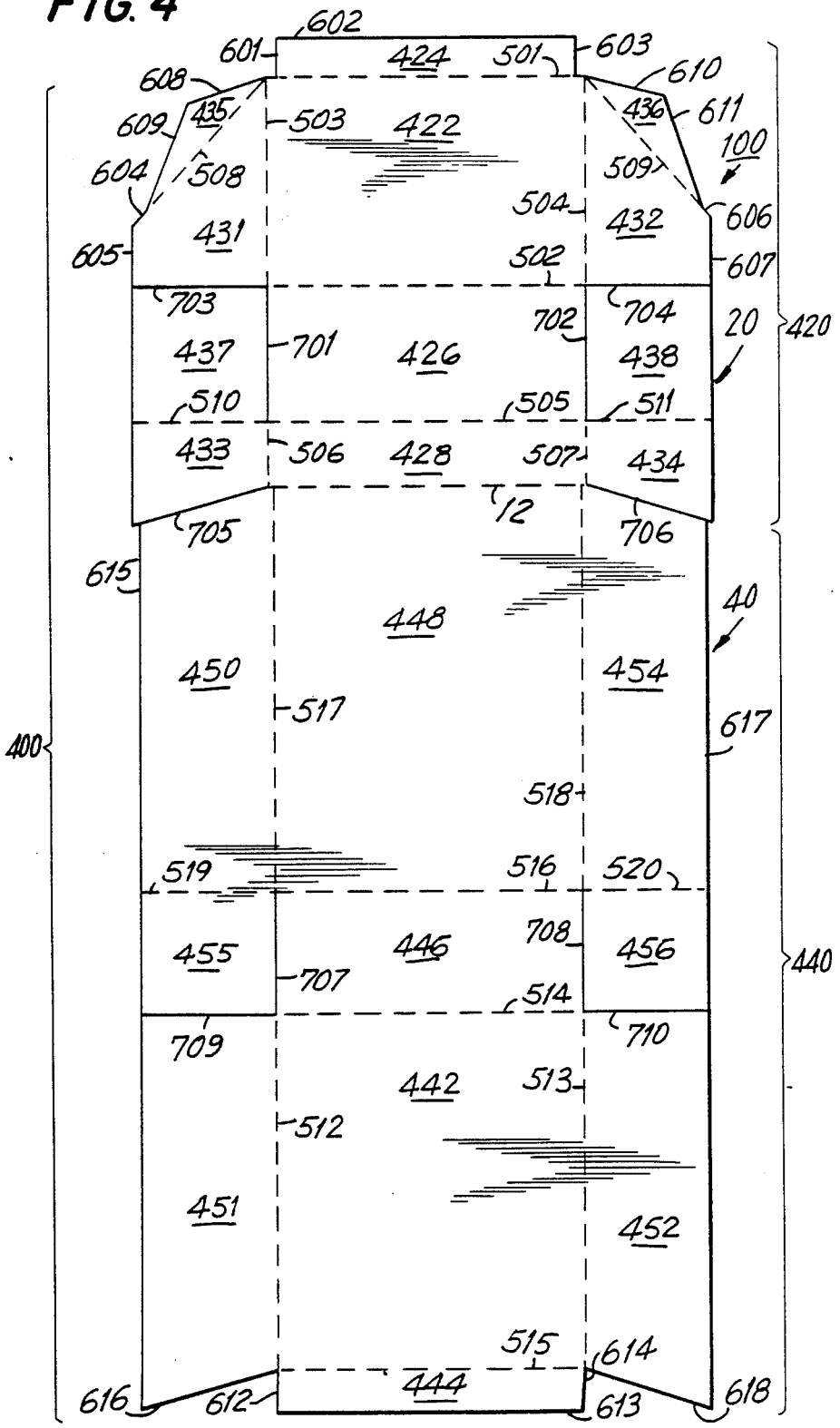
FIG. 4 is a plan view of a blank from which the container of FIGS. 1 and 2 may be erected.

FIGS. 1 and 2 show a container 10 according to a first embodiment of the invention. As shown in FIG. 1, the lid member 20 of container 10 is connected to the base member 40 along hinge line 12. Lid member 20 includes a lid front wall 22, to which a lid flap 24 is connected. Similarly, base member 40 includes a base front wall 42 to which a shoulder 44 is connected and fastened. Lid member 20 also includes a top wall 26 and a lid back wall 28, with lid front wall 22 having an inward facing surface disposed toward lid back wall 28. Similarly, base member 40 has a bottom wall 46 and a base back wall 48, with base front wall 42 having an outward facing surface disposed away from base back wall 48.

When lid member 20 and base member 40 are pivoted about hinge line 12 with respect to each other from the opened position shown in FIG. 1 to the closed position shown in FIG. 2, lid front wall 22 and base front wall 42 are brought into position next to each other. As shown in FIG. 2, however, the sum of the heights of front walls 22, 42 is greater than the sum of the heights of back walls 28, 48, so that lid front wall 22 extends beyond and overlaps base front wall 42. Similarly, side wall 30 of lid member 20 extends over and overlaps side wall 50 of base member 40.

The freshness-preserving means of the invention may be understood more clearly from FIG. 3A, which shows part of container 10, including the area of flap 24 and shoulder 44, in cross-section. Lid front wall 22 is shown in the closed position, while a partially opened position near the closed position is shown in phantom. As lid member 20 approaches the closed position, flap 24 engages shoulder 44 between the inward facing surface of lid front wall 22 and the outward facing surface of base front wall 42. Then, when lid member 20 reaches the fully closed position, flap 24 snaps across the lower edge of shoulder 44, performing a latching function to prevent the flow of air along the front wall of container 10 between front walls 22, 42. This latching function also prevents container 10 from opening accidentally. Furthermore, the sudden movement of flap 24 into the closed position produces a clicking sound which indicates to the user that the container 10 is fully closed, reminding the user of the freshness-preserving charcteristics of the container. If properly dimensioned, flap 24 and shoulder 44 could produce a clicking sound when container 10 is opened, as well as when it is closed.

FIG. 3B shows an alternative embodiment of the freshness-preserving means positioned between the inward facing surface of lid front wall 22 and the outward facing surface of base front wall 42. In the embodiment of FIG. 3B, shoulder 32 is on lid front wall 22, while flap 52 is on base front wall 42. As in FIG. 3A, when lid member 20 reaches the fully closed position, flap 52 slides past the upper edge of shoulder 32, performing the latching function described above, and providing an audible indication that container 10 is fully closed. The embodiments of FIGS. 3A and 3B illustrate that the flap and shoulder are basically two similar flaps, with one flap being free while the other is glued or otherwise fastened in place to provide the shoulder. These two flaps may also be dimensioned to provide the clicking sound, if desired.

FIGS. 3C and 3D show other embodiments of the freshness-preserving means which include adhering means for at least partially resealing container 10. In FIG. 3C, the adhering means may be a piece of tape 54 such as two-sided cellophane tape adhered to the outward facing surface of base front wall 42 in the area contacted by flap 24 when lid member 20 is in the fully closed position. As in FIG. 3A, flap 24 slides across shoulder 44 until it snaps into the latching position. Then, if a small amount of additional pressure is applied, flap 24 adheres to tape 54, resulting in the partial resealing of container 10, providing additional freshness preservation. Furthermore, when lid member 20 is pulled away from the fully closed position, flap 24 will pull away from tape 54 with an audible sound, indicating to the user that container 10 is being opened and reminding the user of the freshness-preserving characteristics of the container. In FIG. 3D, the adhering means instead includes two strips 34, 56 of thin-gauge steel, at least one of which is magnetized, so that when flap 52 slides past shoulder 32, strips 34, 56 are brought into position next to each other, and attract one another. These strips 34, 56 may be foil less than 0.002 inch thick. Strip 34 is held in position between base front wall 42 and an inner frame 60 of container 10.

FIG. 4 shows a one-piece container blank 400 from which container 10 of FIGS. 1 and 2 may be formed.

Hinge line 12 may be defined on blank 400 by weakening the paperboard from which blank 400 is constructed. This weakening may be done by any suitable process, such as scoring, creasing, embossing, or the like. On one side of hinge line 12 is a lid-defining portion 420, and on the other side is a base-defining portion 440.

Lid defining portion 420 includes lid front wall panel 422 defined by parallel long lid front-defining score lines 501, 502 perpendicular to hinge line 12, and by parallel short lid front-defining score lines 503, 504 perpendicular to score lines 501, 502; lid flap panel 424 defined by score line 501 and edges 601, 602, 603 of blank 400; top wall panel 426 defined by score line 502, top-defining score line 505 parallel to score line 502, and cuts 701, 702 perpendicular to score lines 502, 505; lid back wall panel 428 defined by score line 505, hinge line 12 and parallel lid back-defining score lines 506, 507; first lid side wall panel 431 defined by score line 503, first lid side-defining score line 508, cut 703 perpendicular to score line 503, and edges 604, 605 of blank 400; second lid side wall panel 432 defined by score line 504, second lid side-defining score line 509, cut 704 perpendicular to score line 504, and edges 606, 607 of blank 400; third lid side wall panel 433 defined by score line 506, third lid side-defining score line 510, cut 705, and edge 605 of blank 400; fourth lid side wall panel 434 defined by score line 507, fourth lid side-defining score line 511, cut 706, and edge 607 of blank 400; first lid side tab panel 435 defined by score line 508 and edges 608, 609 of blank 400; second lid side tab panel 436 defined by score line 509 and edges 610, 611 of blank 400; first lid closure tab panel 437 defined by score line 510, cuts 701, 703, and edge 605 of blank 400; and second lid closure tab panel 438 defined by score line 511, cuts 702, 704 and edge 607 of blank 400.

Base-defining portion 440 includes base front wall panel 442 defined by parallel long base front-defining score lines 512, 513 perpendicular to hinge line 12, and by parallel short base front-defining score lines 514, 515 perpendicular to score lines 512, 513; shoulder panel 444 defined by score line 515 and edges 612, 613, 614 of blank 400; bottom wall panel 446 defined by score line 514, bottom-defining score line 516 parallel to score line 514, and cuts 707, 708 perpendicular to score lines 514, 516; base back wall panel 448 defined by score line 516 and hinge line 12, and further defined by parallel base back-defining score lines 517, 518; first base side wall panel 451 defined by score line 512, cut 709, and edges 615, 616 of blank 400; second base side wall panel 452 defined by score line 513, cut 710, and edges 617, 618 of blank 400; third base side wall panel 453 defined by score line 517, third base side-defining score line 519, cut 705, and edge 615 of blank 400; fourth base side wall panel 454 defined by score line 518, fourth base side-defining score line 520, cut 706, and edge 617 of blank 400; first base closure tab panel 455 defined by score line 519, cuts 707, 709, and edge 615 of blank 400; and second base closure tab panel 456 defined by score line 520, cuts 708, 710, and edge 617 of blank 400.

The lengths of the panels may be measured along a line perpendicular to hinge line 12. As mentioned above, the sum of the lengths of front wall panels 422, 442 exceeds the sum of the lengths of back wall panels 428, 448 by an overlap length As a result, the inward facing surface of lid front wall 22 extends beyond and faces the outward facing surface of base front wall 42 when container 10 is fully closed. Also, for a pleasing appearance, the length of top panel 426 is slightly greater than the length of bottom panel 446, so that the front walls 422, 442 are parallel in the closed position. The width of top wall panel 426, measured along a line parallel to hinge line 12, will similarly be slightly greater than the width of bottom panel 446. Also, the widths of lid front wall panel 422 and back wall panel 428 will be greater than the widths of base front wall panel 442 and base back wall panel 448, so that lid side wall panels 431–434 accordingly overlap base side wall panels 452–454, as discussed above. As a result of the dimensioning of the panels, the lid flap panel 424 and the shoulder panel 444, also designated the base flap panel, are foldable toward each other so that they engage when container 10 is closed, as shown in FIG. 3A.

FIG. 5 shows container 110, which is an alternative embodiment of the invention. Lid member 120 is connected to base member 140 along hinge line 112, as in the embodiment of FIG. 1. The lid front wall 122 has flap 124 connected to it. Base front wall 142, however, does not include a shoulder as in the embodiment of FIG. 1. Instead, an inner frame 160 has an inner front wall 162 effectively extending base front wall 142 toward lid member 120. A shoulder 164 is connected to inner front wall 162. Although the heights of lid front wall 122 and base front wall 142 are such that they do not overlap, lid front wall 122 has an inward facing surface that extends over an outward facing surface of inner front wall 162, so that flap 124 engages shoulder 164, resulting in the same type of latching function described above in connection with the embodiment of FIG. 1.

The embodiment of FIG. 5 may be erected in part from a conventional one-piece blank from which lid member 120 and base member 140 are formed, connected along hinge line 112. When container 110 is closed, lid member 120 will not overlap base member 140, either on the front or on the sides. As a result, conventional machines may be used to fabricate the outer frame of container 110 without modification. A separate piece of paperboard, however, is used for inner frame 160, and is dimensioned so that shoulder 164 is positioned to engage flap 124 on lid member 120. The manner of this engagement is shown in greater detail in FIG. 6, in which flap 124 is latched against shoulder 164 in the fully closed position. The inner front wall 162 extends below the top of base front wall 142, to permit connection of the inner frame 160 to base member 140 and to protect the contents of the package, such as cigarettes, from being crushed. Lower lid edge 126 and upper base edge 144 abut as shown, but do not overlap.

FIG. 7 shows container 210, another alternative embodiment of the invention which includes features from both of the previously discussed embodiments. As in the embodiment of FIG. 1, lid member 220 overlaps base member 240. Lid front wall 222 overlaps base front wall 242, and lid side walls 230 overlap base side walls 250. Top wall 226 is larger than bottom wall 246, to facilitate the overlap. Lid back wall 228 connects to base back wall 248 along hinge line 212.

As in the embodiment of FIG. 5, container 210 includes an inner frame 260. A shoulder opening 244 is defined in base front wall 242, behind which is an exposed portion of inner front wall 262. As shown in FIG. 8, lid flap 224 engages and latches against the upper edge of shoulder opening 244, shown in solid line. FIG. 8 also shows a nearly closed position of the container 212 in phantom, illustrating how flap 224 slides across the portion of base front wall 242 above opening 244 until it latches.

One advantage of the embodiment of FIG. 7 is that no reverse folding is required, as is necessary to form shoulder 44 in the embodiment of FIG. 1. FIG. 9 shows a portion of a one-piece container blank 900 from which container 210 may be formed. The portion not shown may be the same as blank 400 in FIG. 4. Base front wall panel 942, however, has shoulder opening 944 die cut in it to provide a shoulder along one edge, as shown in FIG. 7. Therefore, no reverse folding is necessary for forming container 210 from blank 900.

The invention has been disclosed as a standard size FLIP-TOP® cigarette box, as shown in FIGS. 1, 2, 5 and 7. It is apparent, however, that the invention is equally applicable to other boxes, including the international size FLIP-TOP® cigarette box and the side-opening cigarette box, an embodiment of which is shown in FIG. 10. Side-opening box 310 has lid member 320 and base member 340. Lid member 320 and base member 340 are connected at hinge line 312 and box 310 can be moved between its opened and closed position by pivoting lid member 320 and base member 340 about hinge line 312. As in the embodiments shown in FIGS. 1, 2 and 7, lid member 320 has a front wall 322 which overlaps front wall 342 of base member 340. Inside the overlap area is a latch similar to that shown in any of FIG. 3A, FIG. 3B or FIG. 8.

Figure 11:
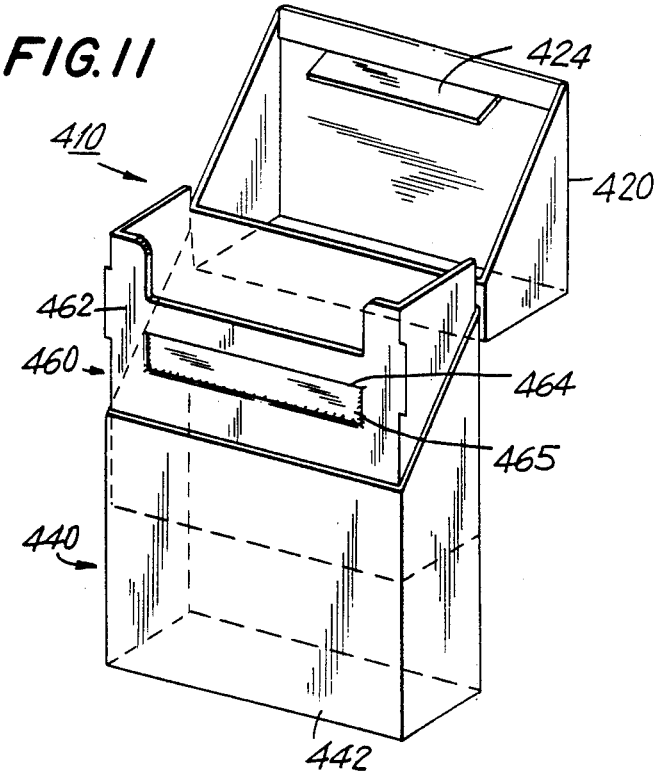
FIG. 11 is a front perspective view of a particularly preferred embodiment of a container according to the present invention in the open position.
Figure 11A:
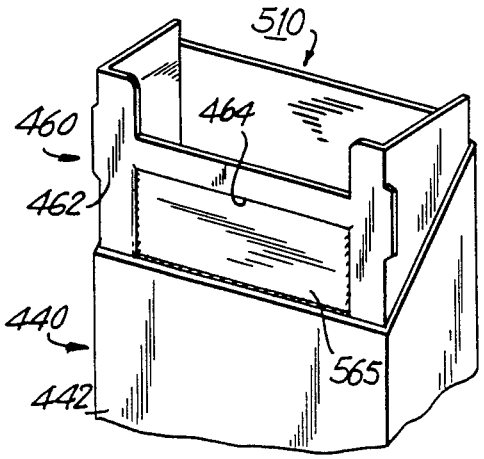
FIG. 11A is a fragmentary front perspective view of a variation of the container of FIG. 11.

A particularly preferred embodiment 410 of the invention is shown in FIG. 11. In this embodiment, container 410 is similar to container 110 of FIGS. 5 and 6, having a base 440 and an inner frame 460. Inner front wall 462 is cut at 464 and an area 465 immediately below cut 464 is debossed. Cut 464 provides a shoulder against which flap 424 on lid member 420 latches. Debossed area 465 is dimensioned to receive flap 424. In a variation 510 of this particularly preferred embodiment, shown in FIG. 11A, the debossed area 565 is made larger than necessary to receive flap 424, extending downward to the top of front wall 442.

Many modifications may be made in the above embodiments through appropriate dimensioning of the flap and the shoulder, so that an especially distinct clicking sound may be obtained on the closing and opening of the container. The adhering means, as shown in FIGS. 3C and 3D, may be two-sided tape or magnetic strips positioned in any appropriate area at which the inward facing surface of the lid front wall faces the outward facing surface of the base front wall. In addition, the adhering means may be a releasable pressure-actuated fastener of the hook-and-loop type, or other similar adhering fabric or tape rather than the two-sided adhesive tape discussed above.

Although the invention has been discussed in terms of the packaging of specific tobacco products, the invention may be used with any appropriate container, including a food container for containing cereal, crackers, biscuits, cheese and so forth. It would also be possible to use the invention with containers for cosmetics or other substances which preferably should be protected from the atmosphere. An example of such a substance would be powder. Similarly, the invention may be used for packaging magnetic tape or video tape, which preferably should be protected from dust in the atmosphere. The invention may also be used for the packaging of magnetic disks or diskettes. Of course, when using the invention with magnetic recording media, magnetic adhering means 34, 56 of FIG. 3D should be avoided.

The adhering means such as tape 54 in FIG. 3C may also include a scent-releasing substance which is activated upon opening the container, further indicating to the user the freshness-preserving characteristics of the container. In addition, other indications of the freshness-preserving characteristics of the container may be provided.

One skilled in the art will recognize that the present invention can be practiced by other than the embodiments described, which are presented for the purpose of illustration rather than limitation, and the present invention is limited only by the claims which follow.

What is claimed is:

1. A freshness-preserving container having a container height and comprising:

a lid member and a base member, said lid member and said base member each having a front wall and a back wall parallel to said front wall, the back walls of said lid member and base member being connected along a hinge line, said lid member and said base member being pivotable about said hinge line between a closed position in which said front walls of said lid member and said base member are next to each other and an open position in which said front walls of said lid member and said base member are spaced apart, said lid member and said base member each having respective side walls, said front and back walls of said lid member being wider than said front and back walls of said base member for enabling the side walls of the lid member to overlap the respective side walls of the base member when said lid and base members are in said closed position, said front wall of said lid member having an inward facing surface thereon disposed toward said back wall of said lid member, said front wall of said base member having an outward facing surface thereon disposed away from said back wall of said base member, and said inward and outward facing surfaces being next to and facing each other when said lid and base members are in said closed position; and freshness-preserving means between said inward and outward facing surfaces for preserving the freshness of contents of said container when said lid and base members are in said closed position.

2. The freshness-preserving container of claim 1 wherein said freshness-preserving means comprises indicating means for producing a sound for reminding the user of the freshness-preserving characteristics of the container.

3. The freshness-preserving container of claim 2 wherein said indicating means comprises a flap on one of said inward and outward facing surfaces and a shoulder on the other of said inward and outward facing surfaces, said flap and said shoulder being positioned for engaging to produce a clicking sound as said lid and base members are pivoted between said open and closed positions.

4. The freshness-preserving container of claim 1 wherein said freshness-preserving means comprises adhering means for at least partially resealing said container when said lid and base members are in said closed position.

5. The freshness-preserving container of claim 4 wherein said adhering means comprises adhesive tape disposed on one of said inward and outward facing surfaces for contacting and adhering to the other of said inward and outward facing surfaces when said lid and base members are in said closed position.

6. The freshness-preserving container of claim 4 wherein said adhering means comprises a first magnetic strip associated with said inward facing surface and a second magnetic strip associated with said outward facing surface and positioned next to said first magnetic strip when said lid and base members are in said closed position, said first and second magnetic strips being for adhering to each other in said closed position.

7. The freshness-preserving container of claim 1 wherein said freshness-preserving means comprises latching means for preventing the flow of air between said front walls of said lid and base members when said lid and base members are in said closed position.

8. The freshness-preserving container of claim 7 wherein said latching means comprises a flap disposed on one of said inward and outward facing surfaces and a shoulder disposed on the other of said inward and outward facing surfaces, said flap and shoulder being positioned and shaped for latching when said lid and base members are in said closed position.

9. The freshness-preserving container of claim 8 wherein said back walls of said lid and base members each have a respective back wall height and said front walls of said lid and base members each having a respective front wall height, the sum of said respective back wall heights equalling said container height and the sum of said respective front wall heights being greater than said container height, said front wall of said lid member overlapping said front wall of said base member.

10. The freshness-preserving container of claim 9 wherein said lid member further comprises a top wall connected between said front and back walls of said lid, said base member further comprising a bottom wall connected between the front and back walls of said base, said top wall being larger than said bottom wall.

11. The freshness-preserving container of claim 9 wherein said outward facing surface of said front wall of said base has a shoulder opening defined therein for providing said shoulder, said flap being on said inward facing surface of said front wall of said lid.

12. The freshness-preserving container of claim 8 wherein said base member further comprises an inner frame including an inner front wall extending toward said lid member for defining said outward facing surface.

13. A blank for the formation of a freshness-preserving container, said blank having a hinge line defined thereon and including a lid defining portion on one side of said hinge line and a base-defining portion on another side of said hinge line opposite said lid-defining portion, wherein:

said lid-defining portion and said base-defining portion each comprises a respective plurality of panels, each panel having a respective length in a direction perpendicular to said hinge line; the panels of each portion being foldably connected to each other along score lines defined on said blank and parallel to said hinge line; said lid-defining portion and said base-defining portion each comprising a respective back wall panel, the respective back wall panels being connected to each other along said hinge line;

said lid-defining portion further comprises a top wall panel connected to said back wall panel of said lid-defining portion, a lid front wall panel connected to said top wall panel, and a lid flap panel connected to said lid front wall panel;

said base-defining portion further comprises a bottom wall panel connected to the back wall panel of said base-defining portion, a base front wall panel connected to said bottom wall panel, and engaging means on said base front wall panel for engaging said lid flap panel;

the sum of the lengths of said lid front wall panel and said base front wall panel exceeds the sum of the lengths of said lid back wall panel and said base back wall panel by an overlap length, and the length of said top wall panel slightly exceeds the length of said bottom wall panel, whereby said lid front panel overlaps said base front panel by said overlap height in a freshness-preserving container erected from said blank, said lid flap panel being foldable toward the engaging means for being engaged upon the closing of said freshness-preserving container; and said lid-defining and base-defining portions each comprise respective side wall panels foldably connected to at least one of the respective front and back wall panels along side-defining score lines defined on said blank and perpendicular to said hinge line, the respective front and back wall panels of said lid-defining and base-defining portions each having a respective width in a direction parallel to said hinge line, the widths of said front and back wall panels of said lid-defining portion exceeding the widths of said front and back wall panels of said base-defining portion for enabling the side panels of said lid-defining portion to overlap the respective side panels of said base-defining portion when the container erected from said blank is closed.

14. The blank of claim 13 wherein the length of said top wall panel is sufficiently greater than the length of said bottom wall panel to enable said lid front panel and said base front wall panel to be parallel when the container erected from the said blank is closed.

15. The blank of claim 13 in which said engaging means comprises a base flap panel connected to the base front wall panel, said base flap panel being foldable toward said lid flap panel for engaging said lid flap panel upon the closing of said freshness-preserving container.

16. The blank of claim 13 wherein said base front wall panel has a shoulder opening defined therein, said engaging means comprising one edge of said shoulder opening, said side of said shoulder opening being for engaging said lid flap panel upon the closing of said freshness-preserving container.

* * * * *

UNITED STATES PATENT AND TRADEMARK OFFICE

CERTIFICATE OF CORRECTION

PATENT NO. : 4,948,038

DATED : August 14, 1990

INVENTOR(S) : Robert E. Moeller

It is certified that error appears in the above-identified patent and that said Letters Patent is hereby corrected as shown below:

Cover page, at item [57] ABSTRACT,
line 5, "fornt" should be -- front --; and
line 8, "freahness" should be -- freshness --.

Column 2, line 57 "resut," should be -- result, --.

Column 4, line 22 "charcteristics" should be -- characteristics --.

Column 5, line 64, "length As" should be -- length. As --.

Claim 14, column 10, line 46, after "front" should be inserted -- wall --.

Signed and Sealed this

Tenth Day of August, 1993

*Attest:*

Michael K. Kirk

MICHAEL K. KIRK

*Attesting Officer*

*Acting Commissioner of Patents and Trademarks*